US005711632A

United States Patent [19]

Garrahan

[11] Patent Number: 5,711,632

[45] Date of Patent: Jan. 27, 1998

[54] SECONDARY CONTAINMENT DEVICE AND METHOD

[75] Inventor: Gary Joseph Garrahan, Terre Haute, Ind.

[73] Assignees: Sony Corporation, Tokyo, Japan; Digital Audio Disc Corporation, Terre Haute, Ind.

[21] Appl. No.: 614,365

[22] Filed: Mar. 12, 1996

[51] Int. Cl.[6] ..... B65D 90/02

[52] U.S. Cl. ..... 405/52; 220/469; 220/565; 588/249

[58] Field of Search ..... 405/52; 588/249; 220/469, 565, 571

[56] References Cited

U.S. PATENT DOCUMENTS

| | | | |
|---|---|---|---|
| 4,715,513 | 12/1987 | Shelton, Jr. | 220/469 |
| 5,116,300 | 5/1992 | Pildysh | 405/52 X |
| 5,236,281 | 8/1993 | Middleton | 405/114 |

*Primary Examiner*—Tamara L. Graysay
*Assistant Examiner*—Tara L. Mayo
*Attorney, Agent, or Firm*—Wood, Herron & Evans, L.L.P.

[57] ABSTRACT

A secondary containment device is provided for protectively containing leaks and spills of a possibly hazardous or otherwise harmful chemical substance contained in a primary container such as a standard thirty or fifty-five gallon chemical drum. The device includes a tubular member with an open bottom equipped with a annular ring or foot of a resilient tacky material that forms a seal with the floor or other surface on which the drum is situated. A chemically resistant plastic material is preferred for the tubular member, which is preferably cylindrical. The foot is preferably triangular and presents a surface that is at least partially upwardly facing on the inside thereof so that the pressure of leaked chemical in the space between the drum and the sidewall of the device contributes sealing force to the foot. Where the floor is not sufficiently smooth to form a seal, a disc or sheet of a preferably plastic material is provided under the drum. The device is preferably dimensioned to produce a space around the drum of a volume sufficient to hold a substantial portion of the contents of the drum.

22 Claims, 1 Drawing Sheet

SECONDARY CONTAINMENT DEVICE AND METHOD

This invention relates to the containment of chemicals and particularly to the configuration and use of secondary devices for the containment of chemical leaks and spills from drums and other primary chemical containers.

BACKGROUND OF THE INVENTION

For safety or general cleanliness in the workplace, efforts have been made to provide secondary containment or backup for chemicals stored or supplied for use in industry. For the secondary containment of flowable chemicals such as liquid chemicals, provision has been made for enclosing the primary chemical containers in a secondary vessel into which the primary vessel is inserted. Such system results in a double walled container that will trap any spills from the inner wall that is formed by the primary container in a space between this inner wall formed by the wall of the primary container and an outer wall formed by the secondary container.

The secondary drum containment has been implemented in the prior art by lifting the drum vertically by a distance usually greater than its height and placing it into the open top of a secondary drum container. Ordinarily, this requires a modification of the drum handling techniques, such as the use of a forklift, that may not be suitable for lowering a drum into a secondary container that might be only a few inches wider than the primary container.

Other protective techniques involve placing the primary chemical containers on containment pallets that function like large saucers or carting the primary chemical container up an incline onto an elevated stage that is provided with pans underneath. These techniques of the prior art take up substantial space and require substantial handling of the chemical drums, which can subject the drums to the risk of being dropped, and thereby spilled or otherwise resulting in a dangerous condition.

Handling of drums has been reduced by the use of temporary berms formed of flexible strips of polymer material to surround the primary chemical containers that are resting on a chemically resistant floor. Such berms do not prevent the chemicals from being splashed over them. These berms are usually only a few inches high, and thus must encircle a substantial amount of floor area around the drum to provide enough volume to effectively contain all of the chemical that can possibly spill.

Given the state of the secondary containment art, there remains a need for a more effective, reliable and convenient method and device for the containment of chemicals susceptible to leakage and spillage from their primary containers.

SUMMARY OF THE INVENTION

A primary objective of the present invention is to provide an effective secondary containment method and chemical containment device.

It is a further objective of the present invention to provide a method of secondary chemical containment that minimizes the handling of the primary containment vessel and reduces the risk of damage to the primary vessel in attempting to provide the secondary containment.

It is a particular objective of the present invention to provide for the secondary containment of a chemical vessel with little or no movement or handling of the primary containment vessel that contains the chemical.

According to the principles of the present invention there is provided a secondary containment device having a generally vertical closed sidewall that is dimensioned to surround the sides of a primary containment vessel of a given geometry. The secondary containment device has an open bottom defined by lower rim of the sidewall that lies in a horizontal plane so that it can rest continuously against a finished industrial floor or other flat chemically resistant surface. Positioned to fit below the lower rim of the sidewall and against the floor or other horizontal supporting surface is a flexible foot that is sealed to the lower sidewall rim and is capable of forming a liquid seal with the supporting surface or floor.

According to the preferred embodiment of the invention, the sidewall is dimensioned to surround the sides of a standard 30 or 55 gallon chemical drum, leaving a space between the drum and the sidewall of at least ten percent of the volume of the primary container and preferably between one and one half and twice the volume or more of the primary container. The preferred height of the secondary container is at least the height of the primary container. The space is at least an inch thick, and preferably more than an inch to allow easy placement of the device over the primary container and to hold a sufficient volume of spilled chemical to allow some lowering of the level of the chemical in the container. In the preferred embodiments, the space has a volume of about half that of the primary container, being about 4 to 6 inches thick where the primary container is a standard 55 gallon drum and 3 to 5 inches thick where the primary container is a standard 30 gallon drum. Preferably still, the secondary device is made of a chemically resistant plastic such as high density polyethylene (HDPE) or polypropylene (PP) plastic and the foot is made of a soft, tacky form of polyurethane or rubber material such as EDPM or VITON. The device may alternatively have an open top or a closed top that includes access holes for the standard openings in the tops of the primary drum. A separate drain may be provided at the bottom of the space to remove spillage therefrom. A pad or disc of similarly chemically resistant material may be provided to be slipped beneath the primary container to provide a better seal with the foot of the containment device than would be afforded by the facility floor.

The containment device of the present invention provides the advantage of being capable of placement around a prepositioned chemical drum, with little or no movement of the drum, to form a sealed secondary volume around the drum that will contain the entire contents of the drum if spilled. The sidewall surrounds the primary container and prevents leaks from spraying chemicals substantial distances from the drum and onto persons in the vicinity. Such a sidewall should be at least high enough to intercept the trajectory of the spraying chemical. The closer the sidewall of the containment device is to that of the primary container, the greater the minimum height of the containment device would be, since the potentially hazardous chemical would be sprayed by the hydrostatic pressure in the primary container a greater distance from a leak near the bottom of the primary container than from a leak near the top.

Further, the device of the invention does not require that the drum be lifted or carted up an incline to place it in a position where spillage can be contained. Such handling, which increases the risk that the container will be dropped or otherwise damaged is avoided. The device of the invention occupies substantially less space than do secondary containment schemes of the prior art. The use of the invention requires little or no additional equipment, such as ramps or drum lifters, requires only one person and takes less time and involves less cost than methods of the prior art.

These and other objectives and advantages of the present invention will be more readily apparent from the following detailed description of the of the preferred embodiments of the invention, in which:

DETAILED DESCRIPTION OF THE PREFERRED EMBODIMENT

Figure 1:
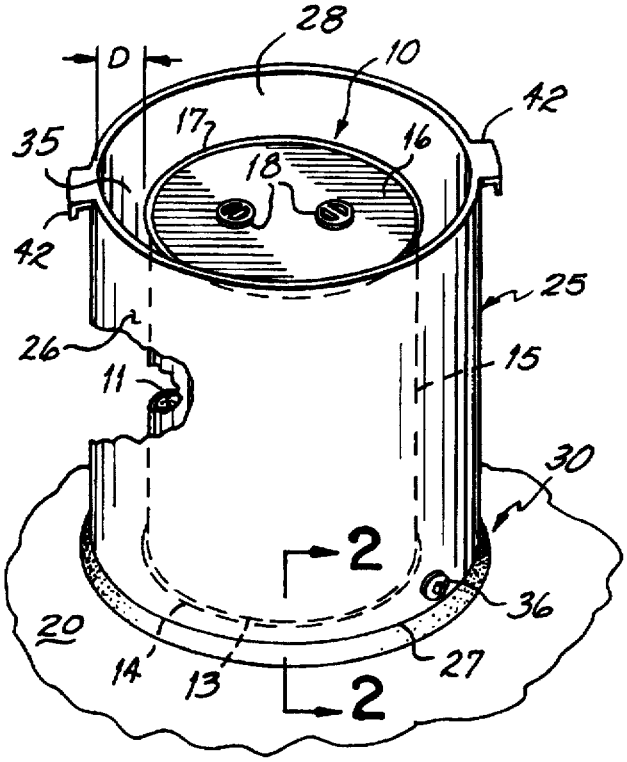
FIG. 1 is an isometric view of a secondary containment device according to one preferred embodiment of the invention being used according to the method of the present invention to secondarily contain a chemical substance that is stored a primary chemical container resting upon a horizontal supporting surface or floor.

In FIG. 1 is illustrated a primary container or containment vessel 10 in which is stored a flowable chemical substance 11, typically in liquid state. Chemical substances 11 that are of particular interest in the context of the present invention are those that are toxic, hazardous or otherwise damaging or harmful to persons or property upon escape from their intended place of containment in the containment vessel 10. Such escape of the chemical substance 11 occasionally occurs in an industrial environment, sometimes where the substance 11 leaks from the container 10, and more often where the substance is spilled when being transferred to or from the primary container.

The primary containment vessel 10 has a given configuration, typically in the form of a cylindrical can or drum. Standard drum containers for chemicals are found in 30 and 55 gallon sizes, each having a standard diameter and height. The standard 55 gallon drum has a cylindrical shape and having a given diameter of about 22.5 inches and a given height of about 29 inches. The container 10 will typically have flat circular metal or plastic base 13 having an outer lip 14 that is sealed to the bottom of a cylindrical tube that forms the side or sidewall 15 of the container 10. A flat circular lid 16 also has an outer lip 17 that is sealably secured to the top of the cylindrical container side 15. In the lid 16 there may be provided a set of plugged openings 18, typically two in number, that are threaded to receive plugs to close the openings 18 and for the connection of pumps or other filling or emptying hardware. Often, chemicals are transferred into or out of the drums merely through hoses or structure that is not threaded or otherwise sealed to the rims of the openings 18. Further, such containers 10 are most often set with the base 13 resting upon a smooth usually concrete floor 20 of an industrial facility in which they are used.

In accordance with the preferred embodiment of the invention, a secondary container 25 is provided having a sidewall 26 in the shape of a vertical tube that is preferably of a cylindrical or of a multi-sided or prismatic shape and is formed of a generally chemically resistant preferably plastic material such as polyethylene, such as HDPE, or polypropylene material approximately 3/16ths of an inch thick. The sidewall 26 is designed surround by a spaced distance D the outer wall or side of the primary chemical container 10, and may be dimensioned specifically to surround any of the standard or other chemical containers that are of given dimensions, usually of a cylindrical shape specified by a diameter and a height. The cylindrical sidewall 26 of the container 25 has a lower rim 27 that is circular and lies in a horizontal plane so that the container 25 will be capable of being solidly supported with the lower rim 27 resting on a flat floor, such as floor 20. The upper end of the container 25 may have an open top 28, such as in the embodiment illustrated in FIG. 1.

At the lower end of the sidewall 26 of the secondary container 25 there is provided a foot 30 of a generally pliable chemically resistant material such as a rubber or plastic. Materials useful for fabrication of the foot 30 are those of the type used for portable dikes or anti-spill berms, such as described, for example, in U.S. Pat. No. 5,236,281, hereby incorporated herein by reference, wherein such materials are referred to as pliable, resilient and inherently tacky. The foot 30 is, in the embodiment shown in FIG. 1 and in more detail in FIG. 2, annular in overall shape and sealably secured to the sidewall 26 around the circumference of the lower rim 27. Preferably, the foot 30 is a low durometer, or generally soft, chemically resistant polymer such as polyurethane or vinyl, or rubber such as EPDM or VITON. The material of which the foot is made is preferably very soft, and will typically seal against a smooth floor with a suction effect, even when wet.

Figure 2:
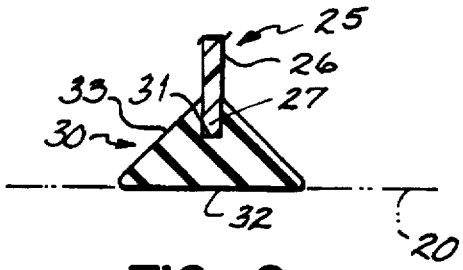
FIG. 2 is a cross-sectional view of the lower lip portion of the device of FIG. 1 along line 2—2 thereof.

In the embodiment of FIG. 2, the foot is triangular in cross-section, with the rim 27 of the sidewall 26 resting in a groove 31 in an upper edge of the foot 30, and having a flat bottom side 32 that is configured to rest upon the floor 20. The material of which the foot 30 is made, or at least of which the bottom surface 32 is formed, should be capable of forming an effective seal with the floor 20 or other surface upon which it rests. With such a cross-sectional shape, an upwardly facing inner side 33 of the foot 30 will be subjected to a standing pressure where the chemical liquid between the sidewall 26 of the secondary container 25 and the outer surface 15 of the container 10 rises to any level, pressing the bottom 32 of the foot 30 against the floor 30 to increase the sealing between the foot 30 and the floor 20.

The volume of the secondary container 25 should be at least ten percent greater than that of the primary container 10, and may even be two times or more the volume of the primary container 10, so that leakage from the primary container 10 into a space 35 between the container outer surface 15 and the sidewall 26 will not rise to a high level above the floor 20, thus minimizing hydrostatic pressure on the seal being formed between the foot 30 and the floor 20. For a 55 gallon drum, the distance D is preferably 4 to 6 inches. To drain accumulated liquid from the space 35, a threaded and plugged opening 36 is provided near the lower rim 27 of the sidewall 26 of the secondary container 25.

Figure 1A:
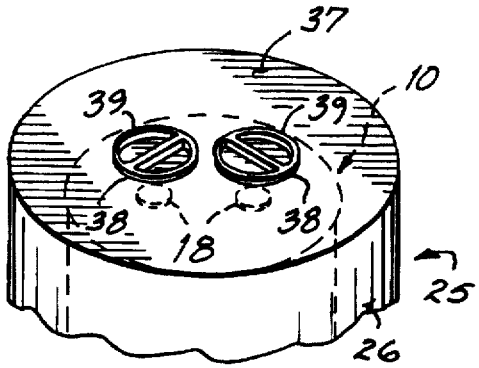
FIG. 1A is a fragmentary isometric view of a portion of an alternative form of secondary containment device of FIG. 1.

In an alternative form of the secondary container or containment device 25 may be provided with a closed top 37, as illustrated in FIG. 1A. The top 37 may be fixed to the upper rim of the sidewall 26 or may be a removable top that sealably connects to the upper rim of the sidewall 26. Whether the top 37 is fixed or removable, it is preferably provided with access holes 38 having removable plugs or caps 39 that will seal the holes 38 and may be removed to permit access to the holes 18 in the top of the primary container 10. The holes 38 are placed to align with and provide access to the standard holes 18 in a given form of the primary container 10, which is most often a chemical drum of a standard type.

Figure 1B:
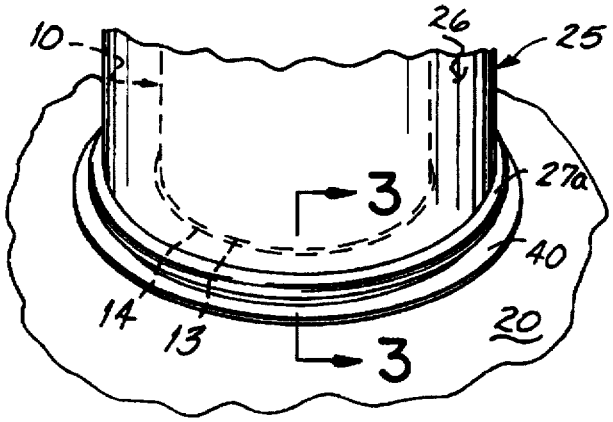
FIG. 1B is a fragmentary isometric view of an portion of another alternative form of secondary containment device of FIG. 1.

While the embodiments of the device 25 are described above for use where the primary container 10 is resting on a floor 20 such as smooth industrial concrete floor, better secondary containment can be provided where the primary container 10 is supported on a floor that may not be sufficiently smooth, finished or chemically resistant by use of a flat sheet or disc 40 beneath the container 10, as illustrated in the embodiment of FIG. 1B. In FIG. 1B, the disc 40 may be of a plastic material similar to that of the container 25, such as polyethylene or polypropylene, also about 3/16ths of an inch thick. Such a disc 40, or other similarly effective sheet or plate, may be positioned on the floor 20 before the drum or primary container 10 is placed there, or may be inserted under the primary container 10 by a slight lifting thereof, such as with a forklift of other drum handling equipment. With such a disc 40, the device 25 is directly supported on the disc 40, and indirectly on the floor 20, with the bottom surface 32 of the foot 30 forming a seal against the disc 40 that is effective to prevent leakage from the bottom of the space 35 when the floor 20 is of a finish that will not allow such an effective seal to form directly against it.

Figure 3:
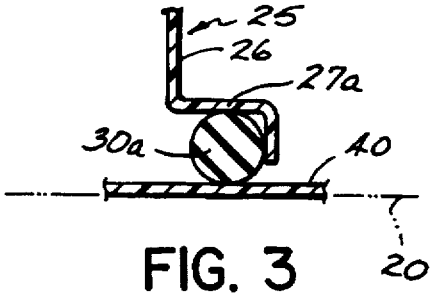
FIG. 3 is a cross-sectional view similar to FIG. 2 of the lower lip portion of the device of FIG. 1 along line 3—3 thereof.
Figure 3A:
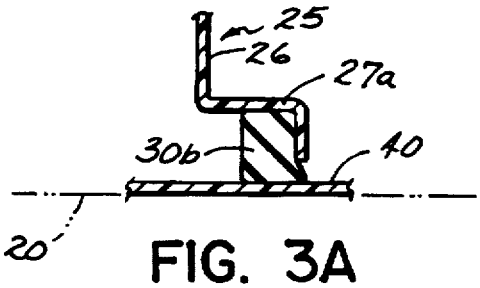
FIG. 3A is a cross-sectional view similar to FIG. 3 of the lower lip portion of the device of FIG. 1 also along line 3—3 of FIG. 2.

FIG. 1B and FIGS. 3 and 3A illustrate alternative configurations for the lower rim of the sidewall 26 of the secondary container 25 and the sealing foot 30. An alternative lower rim 27*a* of sidewall 26 may include an outward flare or step to provide greater horizontal surface contact with the sealing foot, which may be in one of several alternative forms such as the O-ring shaped foot 30*a*, illustrated in FIG. 3, and the trapezoidal shaped sealing foot 30*b*, illustrated in FIG. 3A. Such feet 30*a* and 30*b* may have generally tacky surfaces on the top and bottom sides thereof to insure sealing contact between both the seal 30*a*,30*b* and the lower rim 27*a*, and the seal 30*a*,30*b* and the floor 20 or the disc 40.

Additional structure may be formed on the secondary container 25, such as lifting handles or, as illustrated in FIG. 1, a lifting flange 42 around the upper rim of the sidewall 26.

With the secondary container 25 described above and other embodiments thereof, secondary containment of a chemical container can be achieved without having to lift the primary chemical container 10 and lower the container into an outer drum or other containment vessel. Rather, with the drum 10 resting on a floor 20 or other surface, the secondary container 25 is placed over the primary container 10 and merely lowered so that the foot 30 attached to its lower rim 27 can be pressed and sealed against the floor 20 or other supporting surface. The container 25 so used, provides a secondary containment vessel that is more effective than temporary and portable spill berms and other devices and occupies less floor space by confining spilled chemical from the primary container 10 to a depth of up to the full height of the primary container.

Those skilled in the art will appreciate that the application of the present invention herein are varied, and that the invention is described in preferred embodiments Accordingly, additions and modifications can be made without departing from the principles of the invention.

Accordingly, the following is claimed:

1. A secondary containment device for confining chemical flow from leaks or spills of a chemical substance enclosed in a primary container of a given volume, the primary container having a base, a top, and a tubular side surface of a given horizontal cross-sectional size and shape extending upwardly a given vertical height from the base to the top, when the device is supported with its base resting upon a horizontal surface, the device comprising:

a tubular sidewall of chemically resistant material having a lower rim defining an open bottom and lying in a plane, the sidewall being dimensioned relative to a standard primary container to extend upwardly a distance at least high enough to intercept spray from a leak in the side surface of the primary container and to surround the side surface of the primary container a distance spaced therefrom for forming an annular space between the sidewall and the side surface of a primary container to contain spillage and leakage of the chemical therefrom; and a seal connected in a closed loop around the lower rim of the tubular sidewall for forming a seal against the flow of the chemical substance between the lower rim and the horizontal surface when the device is resting thereupon.

2. The device of claim 1 wherein the tubular sidewall has a closed top.

3. The device of claim 1 further comprising:

a flat sheet of chemically resistant floor covering material positionable beneath the device having a smooth planar support surface on the top thereof, the seal forming the seal between the lower rim and the sheet.

4. The device of claim 1 wherein the sidewall of the device is at least as high as the vertical height of a standard primary container.

5. A secondary containment device for confining chemical flow from leaks or spills of a chemical substance enclosed in a primary container of a given volume, the primary container having a base, a top, and a tubular side surface of a given horizontal cross-sectional size and shape extending upwardly a given vertical height from the base to the top, when the device is supported with its base resting upon a smooth horizontal surface which is supporting the primary container, the device comprising:

a tubular sidewall of chemically resistant material having a lower rim defining an open bottom and lying in a plane so that the device can be lowered over so as to surround the primary container without moving the primary container from the horizontal surface on which it is resting, the sidewall being dimensioned relative to a standard primary container to extend upwardly a distance at least high enough to intercept spray from a leak in the side surface of the primary container and to surround the side surface of the primary container a distance spaced therefrom for forming an annular space between the sidewall and the side surface of a primary container to contain spillage and leakage of the chemical therefrom;

a seal connected in a closed loop around the lower rim of the tubular sidewall for forming a seal against the flow of the chemical substance between the lower rim and the horizontal surface when the device is resting thereupon; and the seal being in the form of a foot of a flexible chemically resistant material sealably connected in a closed loop around the lower rim of the sidewall and having a supporting bottom surface having properties that render it effective to form a seal with the horizontal surface by virtue of the device resting thereupon.

6. The device of claim 5 wherein:

the sidewall of the device is dimensioned to surround the side surface of the standard primary container spaced therefrom a distance averaging at least one inch and to define a space having a volume of at least six gallons between the sidewall and the side surface of a primary container.

7. The device of claim 5 wherein sidewall is dimensioned to form the annular space which is at least ten percent of the volume of a standard primary container.

8. The device of claim 5 wherein the sidewall is dimensioned to form the annular space which is at least fifty percent of the volume of a standard primary container.

9. A secondary containment device for containing leaks or spills of flowable chemical substances from drums thereof, comprising:

a vertical tube having an open end at the bottom thereof and formed of chemically resistant material, the tube being between approximately twenty and thirty inches in diameter and at least approximately two feet in height, the tube having a lower rim lying in a horizontal plane; and an annular ring of chemically resistant soft resilient material sealed to the lower rim of the tube and having a tacky bottom surface that is generally sealable against a smooth underlying planar support surface to prevent the flow of the flowable chemical between the device and the horizontal surface due to the resting of the device on the horizontal surface.

10. The device of claim 9 further comprising:

a flat sheet of chemically resistant floor covering material positionable beneath the device having a smooth planar support surface on the top thereof.

11. The device of claim 9 wherein:

the tube is between approximately 25 and 28 inches in diameter and at least 29 inches in height.

12. The device of claim 9 wherein:

the annular ring has a triangular cross-section, one side of which defines the bottom surface thereof and the upper angle of which is sealed to the lower rim of the tube.

13. The device of claim 9 wherein:

the annular ring has an inner surface that is at least partially upwardly facing.

14. The device of claim 9 wherein:

the vertical tube is cylindrical in shape and formed of chemically resistant plastic material.

15. A method of secondarily containing a chemical enclosed in a primary container and the method comprising the steps of:

supporting the primary container having a chemical substance contained therein on a smooth planar horizontal supporting surface;

providing a secondary containment device having:

a vertically oriented closed tubular sidewall formed of a chemically resistant material, the sidewall terminating in a lower rim of a resilient seal forming material defining an open bottom and lying in a plane; and while the primary container is supported on the surface, lowering the secondary containment device, lower rim first, over the primary container until the device is removably resting on the supporting surface and the lower rim forms a chemical substance flow resisting seal against the supporting surface, with the sidewall spaced from the primary container over the entire circumference and height thereof to form a volume between the device and the primary container sufficient to contain spillage and leakage of the chemical therefrom.

16. The method of claim 15 wherein:

the secondary containment device providing step includes the step of providing the sidewall dimensioned to surround a side surface of the standard primary container spaced therefrom a distance averaging at least one inch and to define a space having a volume of at least six gallons between the sidewall and the side surface of a primary container.

17. The method of claim 15 wherein:

the secondary containment device providing step includes the step of providing the lower rim having sealed in a closed loop thereto a foot of a flexible chemically resistant material having a supporting bottom surface having such properties that render it effective to form a seal with the horizontal surface when resting thereupon.

18. The method of claim 15 wherein:

the primary container supporting step includes the step of placing a flat sheet of chemically resistant floor covering material upon the smooth planar horizontal supporting surface and supporting the primary container thereon; and the secondary containment device lowering step includes the step of lowering the device until the lower rim is sealably supported directly on the sheet and indirectly on the supporting surface.

19. The method of claim 15 wherein:

the secondary containment device providing step includes the step of providing the tubular sidewall having a diameter of between approximately 25 and 28 inches and a height of at least 29 inches.

20. The method of claim 15 wherein:

the secondary containment device providing step includes the step of providing the lower rim having the resilient seal forming material having a triangular cross-section, one side of which defines a seal forming bottom surface thereof.

21. The method of claim 15 wherein:

the secondary containment device providing step includes the step of providing the lower rim having the resilient seal forming material having an inner surface that is at least partially upwardly facing.

22. The method of claim 15 wherein:

the secondary containment device providing step includes the step of providing the tubular sidewall that is cylindrical in shape and formed of chemically resistant plastic material.

* * * * *